US010028582B2

(12) United States Patent
Nilsson et al.

(10) Patent No.: US 10,028,582 B2
(45) Date of Patent: Jul. 24, 2018

(54) STORAGE SYSTEM

(71) Applicant: Elfa International AB, Västervik (SE)

(72) Inventors: Peter Nilsson, Västervik (SE); Lars Ryden, Västervik (SE)

(73) Assignee: ELFA INTERNATIONAL AB, Vastervik (SE)

( * ) Notice: Subject to any disclaimer, the term of this patent is extended or adjusted under 35 U.S.C. 154(b) by 0 days.

(21) Appl. No.: 15/309,107

(22) PCT Filed: May 12, 2015

(86) PCT No.: PCT/EP2015/060444

§ 371 (c)(1),
(2) Date: Nov. 4, 2016

(87) PCT Pub. No.: WO2015/173223

PCT Pub. Date: Nov. 19, 2015

(65) Prior Publication Data

US 2017/0079431 A1 Mar. 23, 2017

(30) Foreign Application Priority Data

May 14, 2014 (EP) ..... 14168248

(51) Int. Cl.
*A47B 88/57* (2017.01)
*A47B 88/427* (2017.01)
(Continued)

(52) U.S. Cl.
CPC ..... *A47B 88/57* (2017.01); *A47B 55/00* (2013.01); *A47B 88/427* (2017.01);
(Continued)

(58) Field of Classification Search
CPC ..... A47B 88/57; A47B 88/477; A47B 55/00; A47B 88/427; A47B 88/906; A47B 67/04;
(Continued)

(56) References Cited

U.S. PATENT DOCUMENTS 3,087,771 A 4/1963 Pari
3,938,870 A * 2/1976 Guest ..... B42F 15/0035 24/486
(Continued)

FOREIGN PATENT DOCUMENTS

CN 2432837 Y 6/2001
CN 2698161 Y 5/2005

OTHER PUBLICATIONS

International Searching Authority, International Search Report and Written Opinion, International Application No. PCT/EP2015/060444, dated Jul. 8, 2015.

*Primary Examiner* — Hiwot E Tefera
(74) *Attorney, Agent, or Firm* — Hubbard Johnston, PLLC

(57) ABSTRACT

A storage system comprising a drawer frame and one or more boxes. The drawer frame comprises first and second guides with a U-shaped cross section, which is open towards the interior of the drawer frame such that flanges of a box can be inserted into the guides to thereby support the box slideably in the drawer frame. Clips are attached slideably to the guides and engage with the box through a clip connection device interacting with a box connection device of the box, which prevents the box from falling out of the frame.

20 Claims, 3 Drawing Sheets

(51) Int. Cl.

| | |
|---|---|
| ***A47B 88/477*** | (2017.01) |
| ***A47B 55/00*** | (2006.01) |
| ***B65D 25/20*** | (2006.01) |
| *A47B 88/906* | (2017.01) |

(52) U.S. Cl.
CPC ..... *A47B 88/477* (2017.01); *B65D 25/20* (2013.01); *A47B 88/906* (2017.01)

(58) Field of Classification Search
CPC ..... A47B 2210/0024; A47B 2088/401; A47B 88/402; A47B 2210/0018; A47B 57/48; A47B 87/02; A47B 88/16; A47B 88/04; A47B 96/00; A47B 2210/0059; A47B 2210/0056; A47B 47/0083; A47B 2031/003; A47B 2031/004; A47B 2031/005; A47B 88/40; B65D 25/20; F16B 12/26; Y10T 24/44026; Y10T 24/344; B62B 3/006
USPC ..... 211/126.15
See application file for complete search history.

(56) References Cited

U.S. PATENT DOCUMENTS

| | | | | |
|---|---|---|---|---|
| 4,650,261 | A * | 3/1987 | Winter | A47B 57/48 108/180 |
| 4,744,612 | A * | 5/1988 | Winter | A47B 57/48 211/186 |
| 4,795,041 | A * | 1/1989 | Remmers | A47F 5/0031 211/126.15 |
| 5,149,027 | A * | 9/1992 | Weber | F16L 3/2235 24/459 |
| 5,588,541 | A * | 12/1996 | Goetz | A47B 87/0215 211/186 |
| 6,079,719 | A | 6/2000 | Tisbo et al. | |
| 6,394,299 | B1 * | 5/2002 | Hupp | B65D 33/2591 220/315 |
| 6,726,040 | B1 * | 4/2004 | Chen | A47F 5/13 108/147.12 |
| 7,240,798 | B1 * | 7/2007 | Chiang | B65D 25/101 206/562 |
| 7,963,408 | B2 * | 6/2011 | Glover | A47B 88/57 211/126.15 |
| 8,584,889 | B2 * | 11/2013 | Cheng | A47B 55/02 220/485 |
| 8,960,822 | B1 * | 2/2015 | Hsu | A47B 88/16 312/334.4 |
| 9,131,773 | B2 * | 9/2015 | Tsai | A47B 88/16 |
| 9,408,462 | B1 * | 8/2016 | Hong | A47L 15/507 |
| 9,456,691 | B2 * | 10/2016 | Tang | A47B 88/04 |
| 9,596,931 | B1 * | 3/2017 | Nimgulkar | A47B 88/08 |
| 2002/0125802 | A1 | 9/2002 | Remmers | |
| 2004/0089625 | A1 * | 5/2004 | Tsai | A47F 5/108 211/126.2 |
| 2008/0093320 | A1 * | 4/2008 | Glover | A47B 67/04 211/126.12 |
| 2008/0246377 | A1 * | 10/2008 | Huang | A47B 88/40 312/334.8 |
| 2013/0063012 | A1 * | 3/2013 | Lu | B62B 3/005 312/334.7 |

* cited by examiner

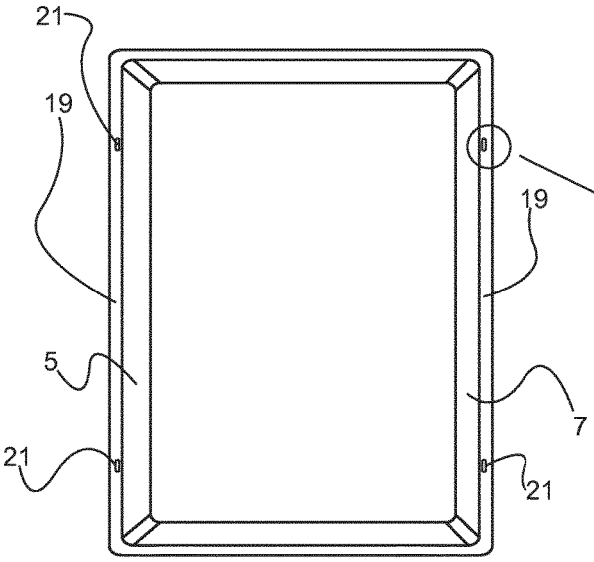
Fig 4
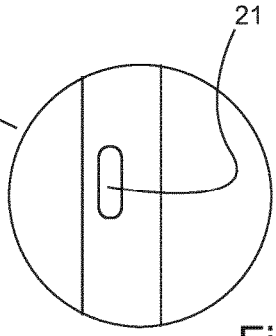
Fig 5
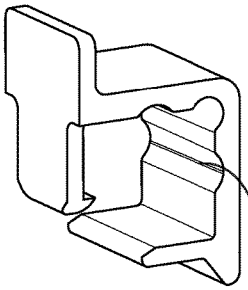
Fig 6B
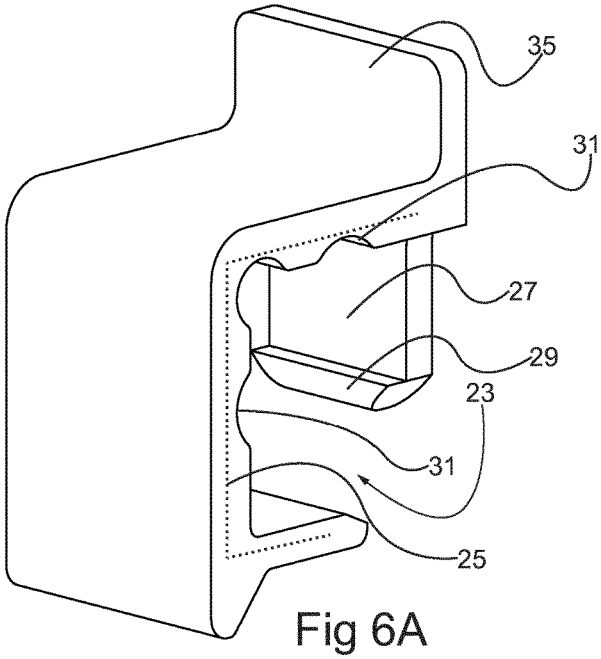
Fig 6A
Fig 7
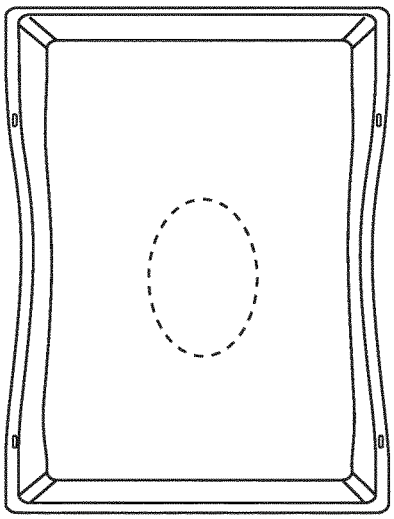

STORAGE SYSTEM

CROSS-REFERENCE TO RELATED APPLICATIONS

The present application is a nationalization of PCT Application International Application No. PCT/EP2015/060444, which claims priority to European Patent Application No. EP14168248.4, filed 14 May 2014, both of which are incorporated herein by reference for all purposes.

The following co-pending and co-assigned application contain related information:

U.S. Nonprovisional patent application Ser. No. 15/309,100 for A Lid and a Storage System, filed concurrently herewith; and U.S. Nonprovisional patent application Ser. No. 15/309,111 for Container and Storage System, filed concurrently herewith.

TECHNICAL FIELD

The present invention relates in general to storage systems, and in particular to modular storage systems including drawer frames and containers.

BACKGROUND

Storage systems are widely used for storing items such as linen and laundry, typically with a container in the form of a metal wire or mesh basket, or the like. One problem with such systems is how to make them more versatile and easy to handle for an end user.

SUMMARY OF INVENTION

One object of the present disclosure is therefore how to provide a system of the initially mentioned kind that is more versatile and easy to use.

This object is achieved by means of a system including a container and at least one clip. The clip is adapted to be slideably attached to a drawer frame guide, with a C-shaped portion of the clip embracing said guide, and to engage with the container with a clip connection device interacting with a container connection device of a flange of the container, such that the clip becomes fixed with regard to the container in the longitudinal direction of the guide. The clip prevents the container from being fully pulled out of the drawer frame and thus prevents the container from falling out of the frame. This makes the use of the system easier for an end user. Further, the clip assists with preventing the deformation of the container if the container is provided with a heavy load, by keeping the flange in connection with the guide of the drawer frame.

The container connection device may be an opening in a container flange, and the clip connection device may be a connector tab of the clip, which tab is adapted to enter the opening, and the end of the connector tab may comprise a tip that is directed inwards, towards the frame guide when the clip is attached to the flange.

The clip may be adapted to abut a drawer frame bar at a stop position of the box, thereby preventing the box from exiting the drawer frame.

The container may be a box that is made of injection molded plastic such as typically polypropylene, and the clip may be made of injection molded plastic such as polycarbonate.

BRIEF DESCRIPTION OF THE DRAWINGS

FIG. 4 shows a top view of a box with openings intended to be used with clips, and FIG. 5 shows an enlarged portion of FIG. 4.

FIG. 6A shows a first perspective view of a clip.

FIG. 6B shows a second perspective view of the clip.

FIG. 7 illustrates schematically a box which is suspended and heavily loaded.

DETAILED DESCRIPTION

The present disclosure is related to modular storage systems including drawer frames and containers. Such systems have the benefit, e.g. as compared with a traditional chests of drawers, of being configurable in various ways to address the needs of an end user. Drawer frames with metal wire and mesh baskets have been widely appreciated by users that have been able to select wire and mesh baskets with different sizes according to their needs.

From a producer point of view, the components involved have allowed for efficient distribution as empty containers can be nested inside other empty containers and since drawer frames can easily be assembled by the end user. This of course reduces the cost of the final system.

It is suggested to include plastic containers with lids in storage systems of this kind as a complement to wire and mesh containers. This would make storage systems of this kind even more versatile.

Plastic containers are relatively inexpensive to produce in large series by injection molding. Unlike a mesh or wire container, a plastic container may be made diffusion tight, and when lids are attached to the containers, the they become stackable, such that a number of containers, with items stored inside, can be stored on a small floor surface. If the storage system is used for instance in a closet, this allows the user e.g. to switch the contents of the closet from season to season.

For instance, during off-season, winter clothes may be stored at another location and, thanks to the more or less diffusion tight properties of the containers, are protected from moisture, etc. When the clothes are needed again, these containers may replace others in the drawer frame. Such a procedure is much more efficient than moving clothes from a drawer to another box, back and forth. The present disclosure provides solutions that make a plastic container more suitable for a storage system of this kind, thereby contributing to accomplishing the goal of obtaining a more efficient and versatile storage system.

Figure 1:
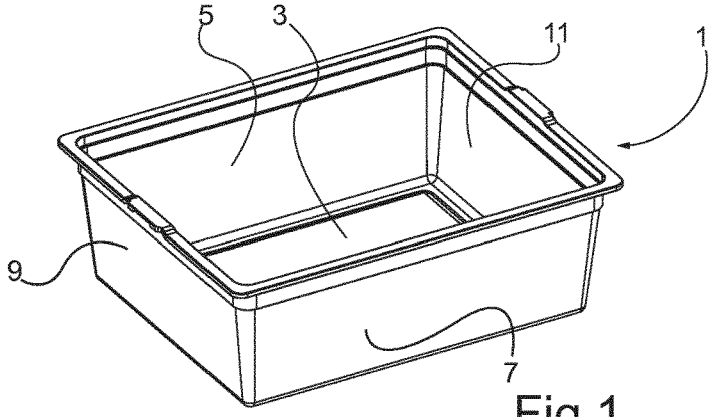
FIG. 1 shows a box.

The present disclosure relates to a container that is used in connection with a drawer frame. An open plastic container 1 in the form of a box is shown in FIG. 1. The box has a bottom portion 3 and first 5, 7 and second 9, 11 pairs of opposing walls rising from the bottom, thereby defining an internal space of the box.

The box has flanges at the upper edges of at least one pair of walls. The flanges extend outwards from the interior of the box in a direction substantially parallel or close to parallel with the plane in which the bottom portion 3 extends. This allows the box to be inserted in a drawer frame.

Figure 3:
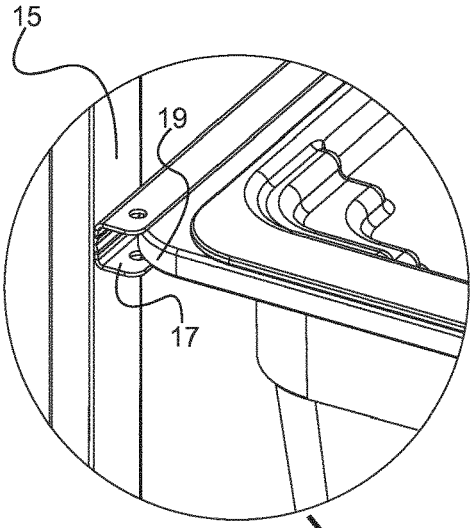
FIG. 3 shows an enlarged portion of FIG. 2.
Figure 2:
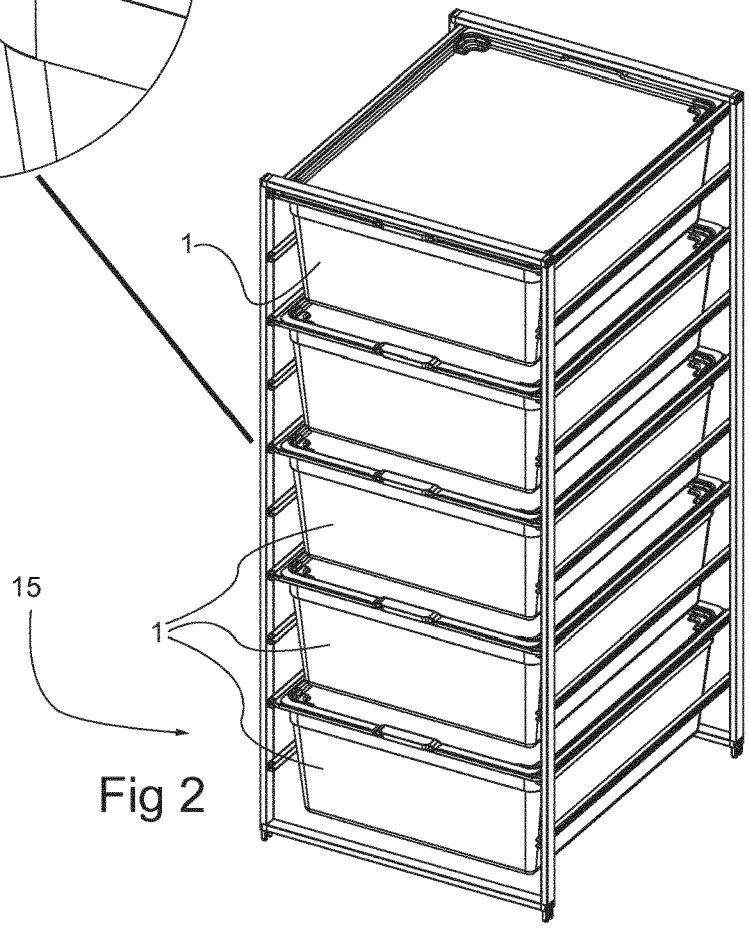
FIG. 2 illustrates five boxes inserted in a drawer frame.

Such a drawer frame 15 is shown in FIG. 2, where five boxes 1 with applied lids are inserted in the frame. FIG. 3 shows enlarged a U shaped guide 17 in the frame, which is adapted to accommodate the flange 19 of the box, in order to support the box in the frame. For each box, the drawer frame 15 comprises a first and a second guide at each side, each having its U-shaped cross section open towards the interior of the drawer frame, such that the flanges of the box can be inserted into the frame. Such frames with guides are well known per se to support containers made of metal wire, metal mesh materials, etc.

The present disclosure seeks to improve container/drawer frame combinations of this kind. This is done by applying a clips on each side of the box that is connected both to the guide and the box.

FIG. 4 shows a top view of a box 1, which is provided with openings 21 which are located in flanges 19 at each side of the box. As illustrated in FIG. 4 and the enlarged portion shown in FIG. 5, two openings are arranged at each side and are located in the flanges close to the walls of the box, such that the openings will be accessible when the box is inserted in the drawer frame. In use, only one opening per flange will be used, and the openings are located, at the longitudinal direction along the flange, at a position that correspond to how far it is desired to allow the box to be pulled out of the drawer frame in order to access the interior of the box. In the illustrated case, the openings are located at symmetrical positions with respect to the longitudinal mid point of each flange, although this is not required. The box may be produced by injection molding of a plastic material such as polypropylene, PP.

As is more clearly shown in FIG. 5, the openings are elongated into a slot in the direction of the flange. The openings may be through holes extending through the flange, although this is not necessary.

FIG. 6A shows a perspective view of a clip 23. The clip may be made in one piece e.g. by injection molding of a plastic such a polycarbonate, PC, or a similar material. However, it would for instance also be possible to make the clip out of thin sheet metal.

The clip 23 includes in cross section a C-shaped portion 25 which in FIG. 6A is indicated with a dotted line and which is intended to surround the outer part of a drawer frame guide when in use. Thanks to this form, the clip is able to take up a load in the direction towards the interior of the drawer frame while at the same time being slideable in the longitudinal direction of the drawer frame guide 17. The clip 23 comprises a connector tab 27 at the open end of the C-shaped portion, which tab functions as a clip connection device. The opening (cf. 21, FIG. 4) in the box flange functions as a box connection device which in use cooperates with the clip connection device or connector tab 27, as will be shown. The clip 23 may further comprise a handling tab 35 that facilitates the mounting of the clip.

The end of the connector tab 27 may include a tip 29 that is directed inwardly, towards the opening of the C-shaped portion. Further, the inner of the C-shaped portion may include one or more recesses 31 that facilitate mounting of the box in the drawer frame as will now be described. The recesses are more clearly shown in the reverse perspective of FIG. 6B.

Figure 8:
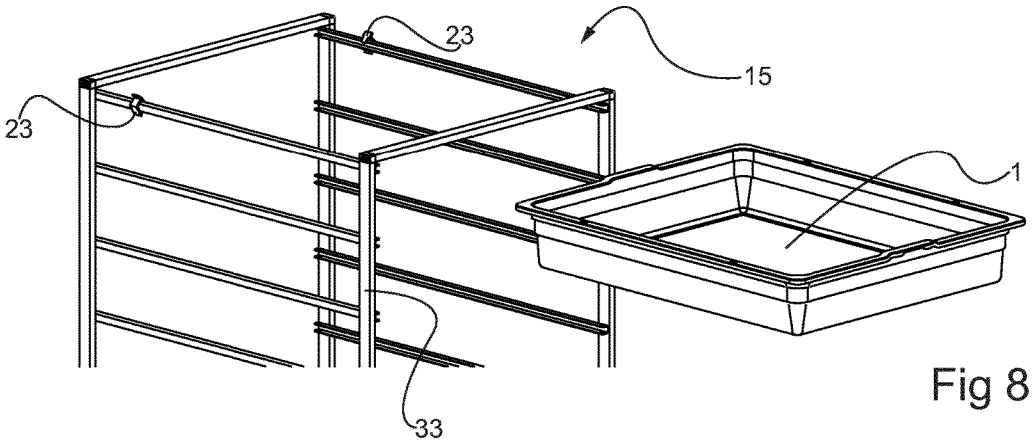
FIGS. 8-11 illustrate the attaching of a box to a drawer frame using clips.
Figure 9:
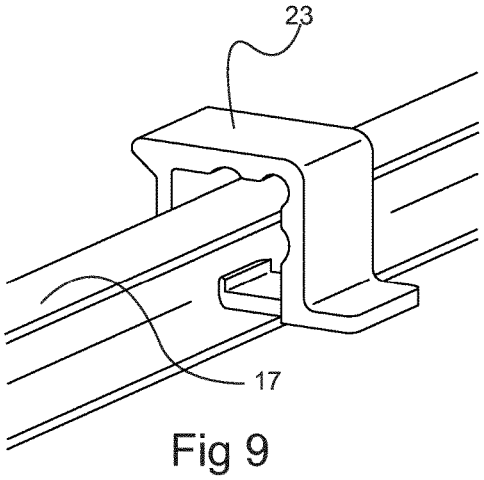

FIGS. 8-11 illustrate the attaching of a box to a drawer frame using two clips. In FIG. 8, the box 1 is about to be inserted into first and second guides 17 of the drawer frame, and one clip is attached to each of the guides. The procedure for attaching the clips is shown in greater detail in FIGS. 9 and 10. To start with, as illustrated in FIG. 9, the clip 23 is threaded over the guide 17 with the C-shaped portion being open downwards.

Figure 10:
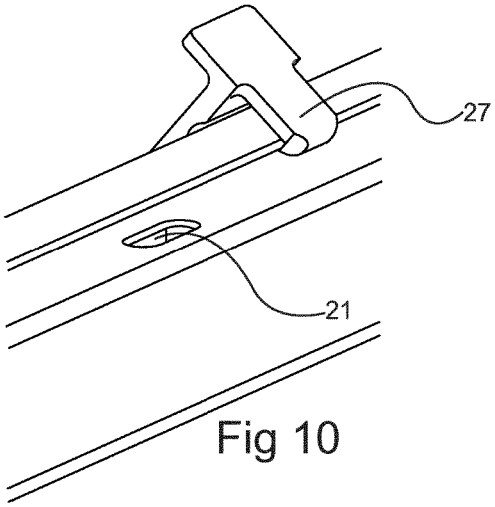
Figure 11:
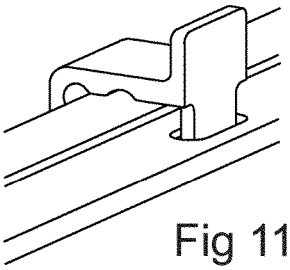

The clip 23 is then turned outwards until it reaches the position in FIG. 10, where the corners of the U-shaped guide 17 snap into recesses 31 inside the C-shaped portion of the clip, and the tip 29 of the connector tab rests against the edge of the guide 17, which means that the clip is stable in this position. As illustrated in FIG. 10, the box may now be inserted into the guides 17, until the opening 21 is aligned with the connector tab 27. At this point, the clip is turned back, such that the tab 27 enters the opening 21, as shown in FIG. 11. The opening may typically be about 10 mm long and the width of the tab may be about 8 mm. Other parts of the clip 23 may typically be 12 mm wide in the elongated direction of the opening. As the opening is wider than the connector tab but narrower than other parts of the clip, the clip cannot be mounted in an incorrect way. The clip on the other guide is attached in the same way.

In this position, the clip snaps into engagement with the box flange 19, and with the C-shaped portion embracing guide, if the box is pulled outwards, the clip will follow, sliding on the guide 17. However, as is evident from FIG. 8, at a front bar 33 of the drawer frame, the clip will stop and will thus stop the box from moving further outwards. Thanks to this feature, the box is prevented from being fully pulled out, such that it cannot fall out of the drawer frame.

Additionally, the clip adds some structural strength to the box 1. For instance, in the situation is illustrated in FIG. 7, a too heavy load (indicated dashed) makes the box bulge when suspended between the flanges of its long sides. A clip of the above illustrated type contributes with reducing this deformation, as the flanges are laterally fixed with regard to the guides where the clips are attached.

Figure 12:
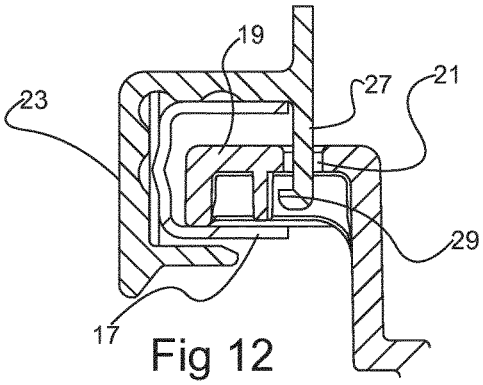
FIG. 12 shows a cross section through a clip when attached to a guide and the flange of a box.

FIG. 12 shows a cross section through a clip 23 when attached to a frame guide 17 and the flange 19 of a box. The connector tab 27 extends through the opening 21 of the flange 19, and as can be seen, the tip 29 reaches inwards towards the frame guide 17. Thanks to the tip 29, which can function as a hook that catches the opening 21 in the flange and reduces the deformation of the box should the box be heavily loaded, the latter can carry heavier loads. This means that a plastic container may be produced with thinner goods for a given allowed storage load.

The present disclosure is not limited to the example described above and may be varied and altered in different ways within the scope of the appended claims. For instance, the opening in the container flange, in which the tab of the clip enters need not be a through hole, a recess may be sufficient. Further, the clip may abut against another item than a frame bar to prevent the container from exiting, such as for instance a stop screw or clamp that may be attached to the guide at a chosen location. In principle only one clip per container is needed to provide the stopping function.

What is claimed is:

1. A storage system comprising:

a drawer frame;

a first guide on a first side of the drawer frame and a second guide on an opposing second side' of the drawer frame, the first and second guides each having a U-shaped cross section opening towards the interior of the drawer frame;

a container comprising:

a bottom;

first and second walls extending from opposing sides of the bottom;

a first flange extending outwardly from the first wall and adapted to be slidably inserted into the first guide of the drawer frame; and a second flange extending outwardly from the second wall and adapted to be slidably inserted into the second guide of the drawer frame; and a clip adapted to longitudinally slide along the first guide and to be attached to the first flange to prevent the container from sliding out of the drawer frame;

wherein the clip comprises a tab and the first flange comprises an opening wherein the tab is adapted for insertion into the opening of the first flange to attach the clip to the first flange; and wherein the first flange comprises a plurality of openings adapted to receive the tab of the clip for selecting a length of longitudinal travel of the container along the first guide.

2. The storage system according to claim 1, wherein an end of the tab comprises a tip that is directed underneath a portion of the first flange when the tab is inserted into the opening.

3. The storage system of claim 1, wherein the clip is adapted to abut a drawer frame bar of the drawer frame at a stop position of the container to thereby prevent the container from sliding out of the drawer frame.

4. The storage system of claim 1, wherein the container comprises a box made of injection molded plastic.

5. The storage system of claim 1, wherein the clip is made of injection molded plastic.

6. The storage system of claim 1, wherein the clip is made at least in part out of metal.

7. The storage system of claim 1, wherein the clip comprises:

a plurality of sidewalls defining a substantially C-shaped opening for slidably receiving corresponding guide outer sidewalls defining the U-shaped cross-section of the first guide; and said tab extending partially across the C-shaped opening for engaging the first flange.

8. A storage system comprising:

a container including:

a base and a plurality of walls extending from the base to define a storage space; and a flange extending outwardly from a selected one of the plurality of walls;

a drawer frame including a guide of a selected length having inner sidewalls for slidably receiving the flange of the container; and a clip assembly adapted to slidably engage the guide and to engage the flange of the container at a selected point to limit a length of travel of the container along the guide;

wherein the flange comprises an opening at the selected point and the clip assembly comprises a tab adapted to be received by the opening for engaging the clip assembly with the flange; and wherein the opening comprises one of a plurality of spaced-apart openings disposed along a length of the flange for selective engagement with the clip assembly to allow selection of the length of travel of the container along the guide.

9. The storage system of claim 8, further comprising:

a second container including:

a base and a plurality of walls extending from the base to define a storage space; and a flange extending outwardly from a selected one of the walls;

a second guide disposed on the drawer frame and vertically spaced from the guide, the second guide of the selected length and having inner sidewalls for slidably receiving the flange of the second container; and a second clip assembly adapted to slidably engage the second guide and to engage the flange of the second container at a selected point to limit a length of travel of the second container along the second guide.

10. The storage system of claim 8, wherein the base, walls, and flange of the container are formed of plastic.

11. The storage system of claim 8, wherein the clip assembly is formed of plastic.

12. A storage system comprising:

a container including:

a base and a plurality of walls extending from the base to define a storage space;

a first flange extending outwardly from a selected one of the plurality of walls; and a second flange extending from a second one of the plurality of walls opposing the selected one of the plurality of walls;

a drawer frame including a first guide of a selected length having inner sidewalls for slidably receiving the first flange of the container, and a second guide of the selected length and laterally spaced from the first guide, the second guide having inner sidewalls for slidably receiving the second flange;

a first clip assembly adapted to slidably engage the first guide and to engage the first flange of the container at a selected point to limit a length of travel of the container along the first guide; and a second clip assembly adapted to slidably engage the second guide and to engage the second flange of the container at a selected point to limit a length of travel of the container along the second guide;

wherein the second flange comprises an opening at the selected point and the second clip assembly comprises a tab adapted to be received by the opening of the second flange for engaging the second clip assembly with the second flange; and wherein the opening of the second flange comprises one of a plurality of openings formed at spaced-apart points along the length of the second flange.

13. A storage system comprising:

a container including:

a base and a plurality of walls extending from the base to define a storage space; and a flange extending outwardly from a selected one of the plurality of walls;

a drawer frame including a guide of a selected length having inner sidewalls for slidably receiving the flange of the container; and a clip assembly adapted to slidably engage the guide and to engage the flange of the container at a selected point to limit a length of travel of the container along the guide;

wherein:

the guide comprises first, second, and third walls defining a substantially U-shaped cross-section with a guide opening for receiving the flange;

the flange comprises an opening; and the clip assembly comprises:

first, second, and third sidewalls defining a substantially C-shaped opening for slidably receiving corresponding the first, second, and third walls of the guide; and a tab for extending partially across the guide opening for engaging the opening of the flange.

14. The storage system of claim 13, further comprising a projection extending at an angle from an end of the tab for retaining the tab in engagement with the flange.

15. A storage system comprising:

a drawer frame;

a first guide on a first side of the drawer frame and a second guide on an opposing second side of the drawer frame, the first and second guides each having a U-shaped cross section opening towards an interior of the drawer frame;

a container, comprising:

first and second walls extending from opposing sides of a bottom;

a first flange extending outwardly from the first wall and adapted to be slidably inserted into the first guide of the drawer frame; and a second flange extending outwardly from the second wall and adapted to be slidably inserted into the second guide of the drawer frame;

wherein the first flange is comprised of a first end, a second end opposed the first end, a longitudinal midpoint between the first and second ends, and an opening located between the midpoint and the first end;

a clip for longitudinally sliding along the first guide while attached to the first flange to prevent the container from sliding out of the drawer frame, the clip having a tab for extending through the opening in the first flange.

16. The storage system of claim 15, wherein the first flange comprises a second opening located between the midpoint and the second end, the opening located between the midpoint and the first end and the second opening being symmetrically located with respect to the midpoint.

17. The storage system of claim 16 wherein the opening located between the midpoint and the first end and the second opening are adapted for receiving the clip for selecting a length of longitudinal travel of the container along the first guide.

18. The storage system of claim 16, wherein the tab is comprised of a tip for catching the opening located between the midpoint and the first end in the flange when the tab is inserted.

19. The storage system of claim 15, wherein the container is made of plastic.

20. The storage system of claim 15, wherein the second flange is comprised of, a first end, a second end opposed the first end, and a longitudinal midpoint between the first and second ends, and a first opening between the midpoint and the first end, and a second opening between the midpoint and the second end, the first and second openings being symmetrically located with respect to the midpoint; and the storage system is further comprised of a second clip for longitudinally sliding along the second guide while attached to the second flange to prevent the container from sliding out of the drawer frame, the second clip having a tab for extending through either of the first and second openings in the second flange.

* * * * *